US006544389B2

(12) United States Patent
Johnson

(10) Patent No.: US 6,544,389 B2
(45) Date of Patent: Apr. 8, 2003

(54) MOLDED MODULAR LINK AND A FABRIC MADE FROM A PLURALITY THEREOF

(75) Inventor: C. Barry Johnson, Mt. Pleasant, SC (US)

(73) Assignee: AstenJohnson, Inc., Charleston, SC (US)

( * ) Notice: Subject to any disclaimer, the term of this patent is extended or adjusted under 35 U.S.C. 154(b) by 0 days.

(21) Appl. No.: 10/078,012

(22) Filed: Feb. 19, 2002

(65) Prior Publication Data

US 2002/0095815 A1 Jul. 25, 2002

Related U.S. Application Data

(63) Continuation of application No. PCT/US00/22723, filed on Aug. 18, 2000.

(60) Provisional application No. 60/150,068, filed on Aug. 20, 1999.

(51) Int. Cl.[7] ..... D21F 7/12

(52) U.S. Cl. ..... 162/348; 162/902; 162/904; 428/52; 428/134; 139/383 AA

(58) Field of Search ..... 162/206, 207, 162/306, 348, 358.2, 358.4, 900, 901, 902, 903, 904; 139/383 A, 383 AA, 425 A; 34/114, 116, 123; 428/33, 44, 52, 58, 99, 131–140; 198/844, 850–853

(56) References Cited

U.S. PATENT DOCUMENTS

| | | | | |
|---|---|---|---|---|
| ,500,521 | A | | 6/1893 | Wickers |
| 1,663,298 | A | | 3/1928 | Geer et al. |
| 1,925,917 | A | | 9/1933 | Chalon |
| 3,121,660 | A | | 2/1964 | Hall, Jr. |
| 3,262,549 | A | | 7/1966 | Stewart et al. |
| 3,920,117 | A | | 11/1975 | Roinestad |
| 4,050,323 | A | | 9/1977 | I'Anson |
| 4,140,025 | A | | 2/1979 | Lapeyre |
| 4,159,763 | A | | 7/1979 | Kewley et al. |
| 4,170,281 | A | | 10/1979 | Lapeyre |
| 4,186,566 | A | | 2/1980 | AuYoung |
| 4,394,901 | A | | 7/1983 | Roinestad |
| 4,469,221 | A | | 9/1984 | Albert |
| 4,537,658 | A | | 8/1985 | Albert |
| 4,575,472 | A | | 3/1986 | Lefferts |
| 4,579,771 | A | | 4/1986 | Finn et al. |
| 4,842,905 | A | | 6/1989 | Stech |
| 4,993,543 | A | | 2/1991 | Lapeyre |
| 5,004,097 | A | | 4/1991 | Roinestad et al. |
| 5,101,966 | A | | 4/1992 | Lapeyre |
| 5,125,504 | A | * | 6/1992 | Corlett et al. ..... 198/850 |
| 5,197,591 | A | | 3/1993 | Roinestad et al. |
| 5,213,203 | A | | 5/1993 | Kinney et al. |
| 5,215,185 | A | | 6/1993 | Counter et al. |
| 5,253,749 | A | | 10/1993 | Ensch |
| 5,303,818 | A | | 4/1994 | Gruettner et al. |
| 5,310,045 | A | | 5/1994 | Palmaer et al. |
| 5,330,604 | A | | 7/1994 | Allum et al. |
| 5,372,248 | A | | 12/1994 | Horton |
| 6,402,895 | B1 | * | 6/2002 | Best ..... 162/358.2 |

FOREIGN PATENT DOCUMENTS

| | | | |
|---|---|---|---|
| DE | 3735709 | A1 | 5/1989 |
| EP | 0250421 | B1 | 9/1990 |
| EP | 0763623 | A1 | 3/1997 |
| EP | 0802280 | A2 | 10/1997 |
| WO | WO9202677 | | 2/1992 |
| WO | WO9217643 | | 10/1992 |

* cited by examiner

*Primary Examiner*—Steven P. Griffin
*Assistant Examiner*—Eric Hug
(74) *Attorney, Agent, or Firm*—Volpe and Koenig, P.C.

(57) ABSTRACT

A link for making a modular papermaking fabric by interconnecting with other links is made through molding techniques to have predetermined characteristics such as open area, permeability, surface finish, etc. A papermaking fabric is constructed from a plurality of interconnected links and has predetermined permeability established by the combination of open and contact areas on each link.

10 Claims, 12 Drawing Sheets

FIG. 6
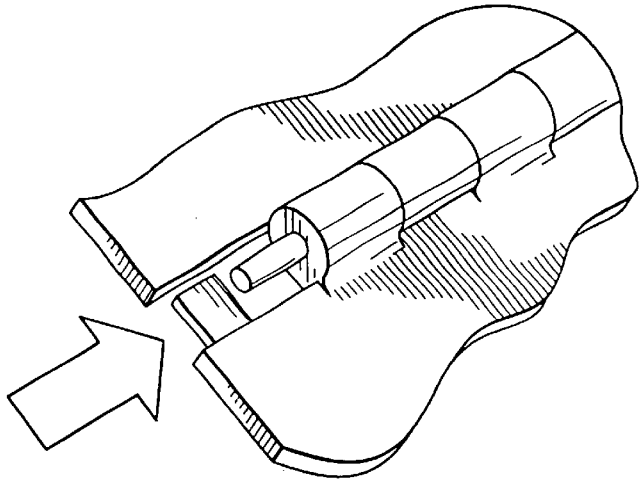
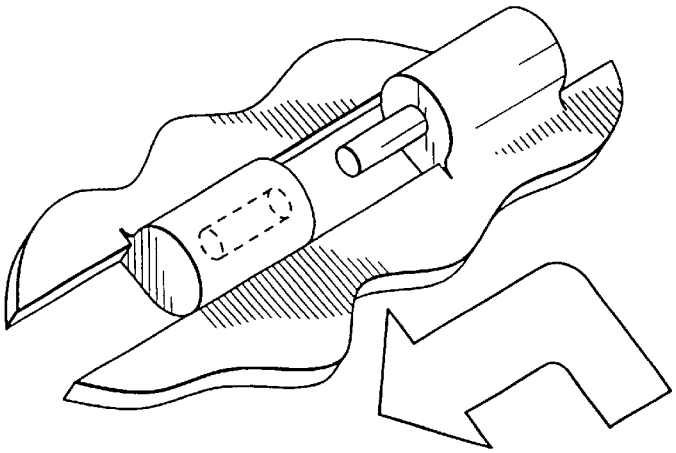
FIG. 7
FIG. 8
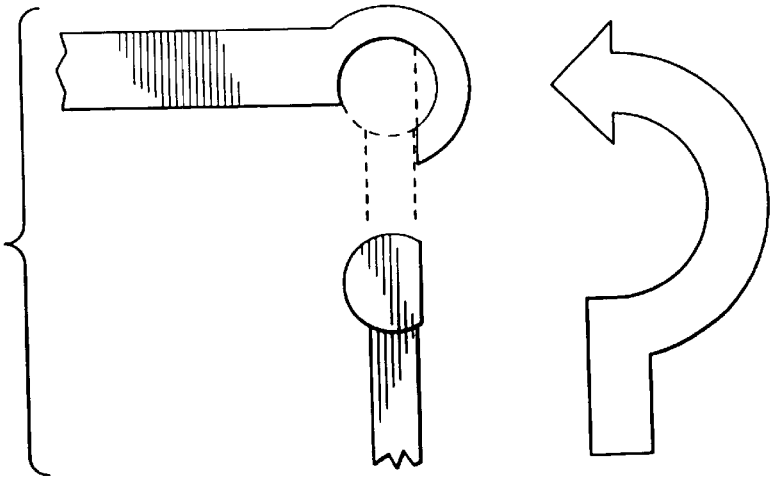

MOLDED MODULAR LINK AND A FABRIC MADE FROM A PLURALITY THEREOF

CROSS-REFERENCE TO RELATED APPLICATIONS

This application is a continuation of PCT/US00/22723, filed Aug. 18, 2000, which claims the benefit of U.S. Provisional application 60/150,068, filed Aug. 20, 1999, which are incorporated herein by reference as if fully set forth.

BACKGROUND

The present invention relates to papermaking fabrics, especially dryer fabrics. More specifically it relates to fabrics made from interconnected modular subassemblies. Most specifically it relates to pre-molded subassembly links used to make a modular fabric.

A papermaking fabric is used in the form of an endless belt which is supported by and advanced through the papermaking machine by various machine rolls. The process and the various sections of the machine, forming, press and dryer, will be known to those skilled in the art.

Traditionally fabrics have been made either through endless or flat weaving techniques. More recently, spiral fabrics have been made by connecting spiral coils with pintles to create a fabric. The spiral fabrics have allowed for greater flexibility in making fabrics of various dimensions, unlike flat or endless woven fabrics whose dimensions must be known ahead of time and are limited by loom design. The spiral fabric, however, lacks adaptability with regard to desired changes in drainage, permeability and surface characteristics.

Papermaking fabrics, especially dryer fabrics, commonly comprise woven monofilament yams. The monofilaments have traditionally been extruded from materials such as nylon, polyester, etc. Unfortunately, the extrusion process renders many plastics unsuitable for use in the harsh environment of the paper machine's dryer section.

Therefore, the choice of materials suitable for use in forming the monofilament has been limited. Many more plastics would become available if a dryer fabric could be made with molding techniques. To date, few practical mechanisms exist for constructing fabrics from molded parts.

One prior attempt at forming a dryer fabric for a paper machine from molded components is described in DE 37 35 709 A1. This reference discloses flat plastic elements which are interconnected by pintles or articulated joints, with the spacing of the elements and the size of the apertures therethrough being selected to provide a desired air permeability for the fabric. However, each of the molded components extends across an entire width of the fabric and there is no teaching of the necessary features to successfully practice the invention in connection with commercial papermaking dryer fabrics, which typically have a width of 10 meters (30 feet). There is also no suggestion as to how such molded components, which extend across an entire fabric could be economically manufactured and assembled, or of molded subassemblies having a width smaller than the entire fabric width or a manufacturable aspect ratios and thicknesses for such subassemblies which can be assembled together to form a dryer fabric. Additionally, this references teaches punched or stamped through openings which are formed in the flat elements or the fabric after it is assembled. This introduces additional cost as well as increased potential for damage to the pintles.

U.S. Pat. No. 4,842,905 discloses a non-woven papermaking fabric assembled from elements interconnected by a complementary geometric shapes in a tessellation (i.e. constructed in the style of a checkered mosaic). Standardized "jig-saw puzzle" type interlocking elements which are interconnected along their longitudinal edges by integral male members or projections along a first longitudinal edge of one element being engaged with female members or recesses located along the second longitudinal edge of the adjacent member. These complementary projections and recesses are interlocked under normal machine tensions. However, such arrangements have not been applied in practice since positive connection of such elements cannot be guaranteed, and in paper machine applications, papermaking fabrics must operate continuously for months without failure of the connections holding the fabric together. There is also no suggestion of the thickness and tensile strength requirements needed in order to realize a dryer fabric utilizing such elements.

U.S. Pat. No. 4,537,658 also discloses a fabric comprised of generally rectangular, elongate elements whose lengths are equal to the finished fabric width. The elements are provided with generally "t" shaped slots extending completely along one longitudinal edge through which a pintle is inserted to interconnect the elements to form the fabric. The pintle itself is required to have a shape that is complementary to the shape of the slots in the elements and must be glued, welded, or bolted in position so that it is retained within the fabric. These elements are extruded, and can not be economically molded based on their size, and any apertures would have to be formed in a separate operation. Additionally, there is no suggestion of thickness and tensile strength requirements for forming such a fabric which can be manufactured economically and used as a dryer fabric.

Present dryer fabrics form endless belts passing around rollers having diameters from 18 to 60 in. (45.7 to 152.4 cm). While flexibility is an important requirement, fabrics also must be strong enough to support the paper web along its path under a variety of conditions and temperatures. Suggested load capacities have been fifteen pounds per linear inch (PLI) (267.9 kg/m). The fabric must also withstand traveling at greater than 4,000 feet per minute (1219.2 m/min).

Damage and dirt accumulation are also major factors which typically limit the maximum useful life of the fabric to about one year. Fabric edges are particularly vulnerable because of a tendency of the yams to unravel and shift. Once damaged, the entire fabric must be replaced. Although traditional woven fabrics have been limited in size by loom construction, they have still reached as much as thirty feet wide by three hundred feet long. Damage to even a small area of the fabric necessitates costly replacement of the entire fabric.

Even minor marring of the surface may deteriorate fabric quality because the paper contact surface characteristics greatly affect the final paper product. Traditional fabrics adjust these characteristics through choice of materials and the type of weave used. Often, a compromise between the best material or the best weave and final product quality must be made. Batting or other material has been affixed to the paper support surface to gain benefits not available from standard materials and weaves. A molded fabric offers greater flexibility in this regard, as surface characteristics may be incorporated directly into the mold and repeated consistently throughout the fabric.

The use of molded fabrics will benefit the art in many ways. A more direct process, avoiding additional storage and coiling requirements of monofilament yams, as well as reducing trimming time and eliminating sealing will be enjoyed by using molded fabrics. More choices of less expensive material will become available, including lower molecular weight materials and gels having less stringent filtration requirements. The molding process also allows the use of composite materials to achieve more beneficial physical properties while maintaining cost effectiveness. A molded fabric allows greater flexibility and efficiency in design when creating fabric patterns (i.e., weave patterns and fabric dimensions). A fabric assembled from pre-molded subassemblies is strong, dimensionally stable, thermally stable, easy to join, distortion free, and has tough finished edges. Furthermore, use of a molded fabric limits fabric stretch, reduces costs, facilitates repair and generally benefits the papermakers art.

SUMMARY

The present invention is a pre-molded plastic subassembly for making papermaking fabrics. A plurality of the subassemblies are interconnected to create an endless fabric. The completed fabric also forms a part of the present invention.

BRIEF DESCRIPTION OF THE DRAWINGS

FIG. 6 is a perspective view of a pintle system for interconnecting the subassembly links of the present invention.

FIG. 7 is a perspective view of a pin lock system for interconnecting the subassembly links of the present invention.

FIG. 8 is a side elevational view of a D-link system for interconnecting the subassembly links of the present invention.

DETAILED DESCRIPTION OF THE PREFERRED EMBODIMENTS

Throughout the figures of the various embodiments of the present invention, like elements are identified with the same numerals.

The invention may be described generically as comprising a pliable, modular link 10, as shown in FIGS. 1–4. The link 10 is molded from appropriate plastics by molding techniques as are well known in the art. The link 10 has a planar upper support surface 20 for supporting and carrying the paper web and is molded to have a predetermined open area or permeability, based upon fabric needs and product demands. Finally, the link 10 is provided with means for interconnecting with other links to form an endless papermaking fabric. The completed fabric will be made of a plurality of interconnected links 10.

Materials and dimensions are chosen for a combination of reasons taking into account fabric demands and tooling concerns. Nylon 6/6 material, available from Dupont under the trademark Zytel®, is useful because of its desirable properties of strength, flexibility, impact resistance, heat performance and good mold processability. Other materials and specialized higher heat grades of resin may be used.

Figure 14:
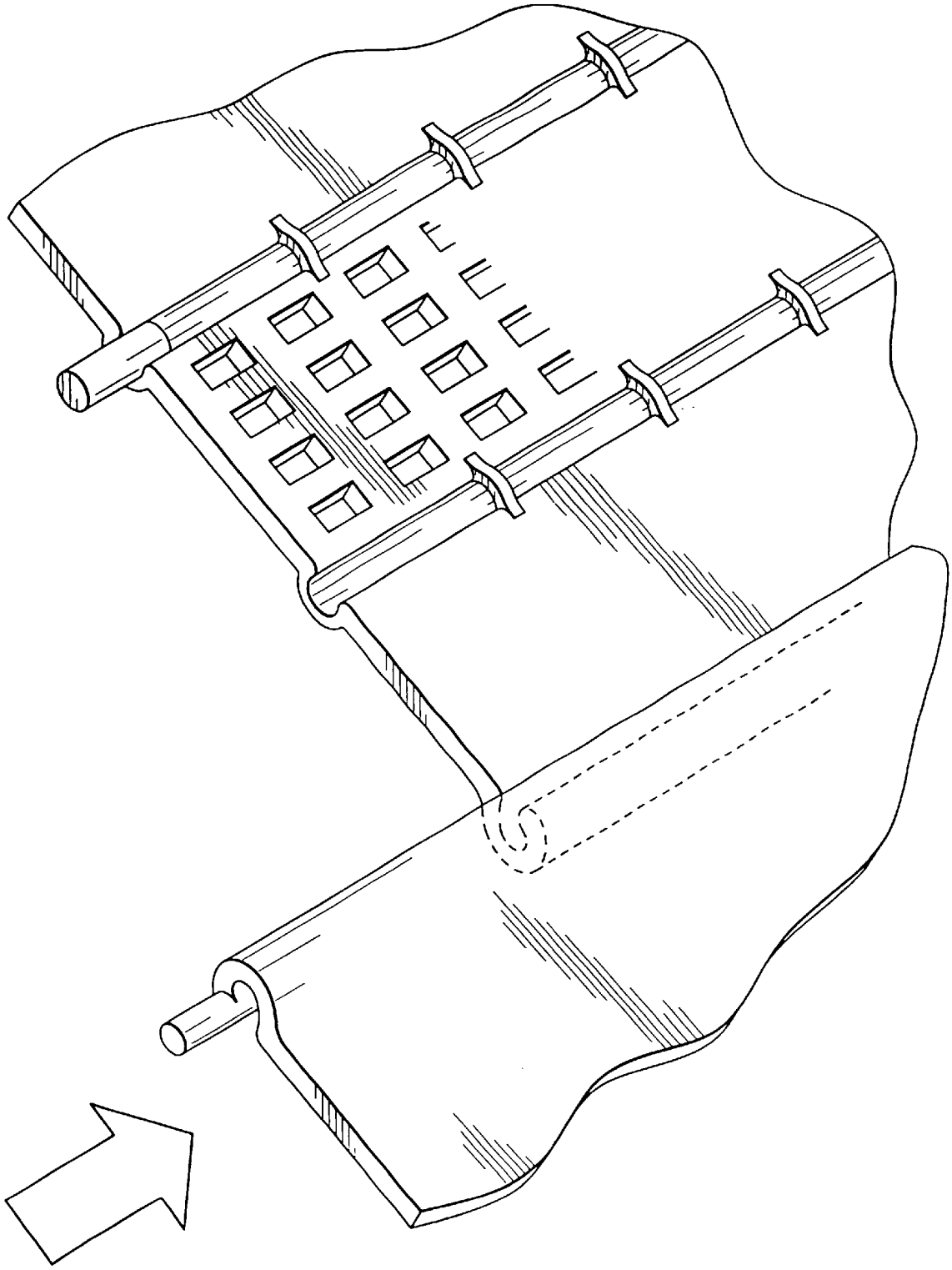
FIG. 14 is a perspective view of a alternative link base with a sliding system for interconnecting the subassembly links of the present invention.
Figure 15:
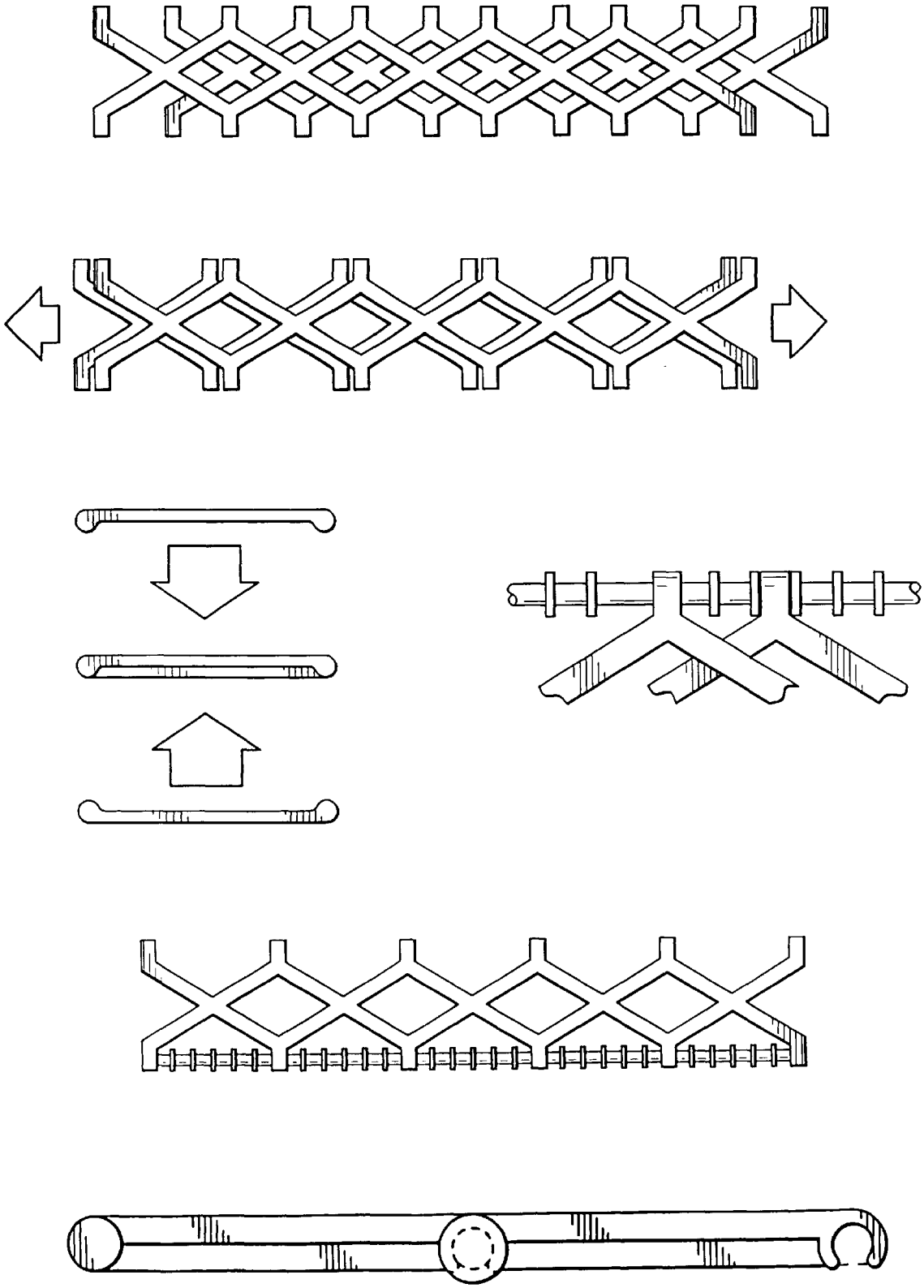
FIG. 15 is a plan view of an alternative bi-component link of the present invention.
Figure 16:
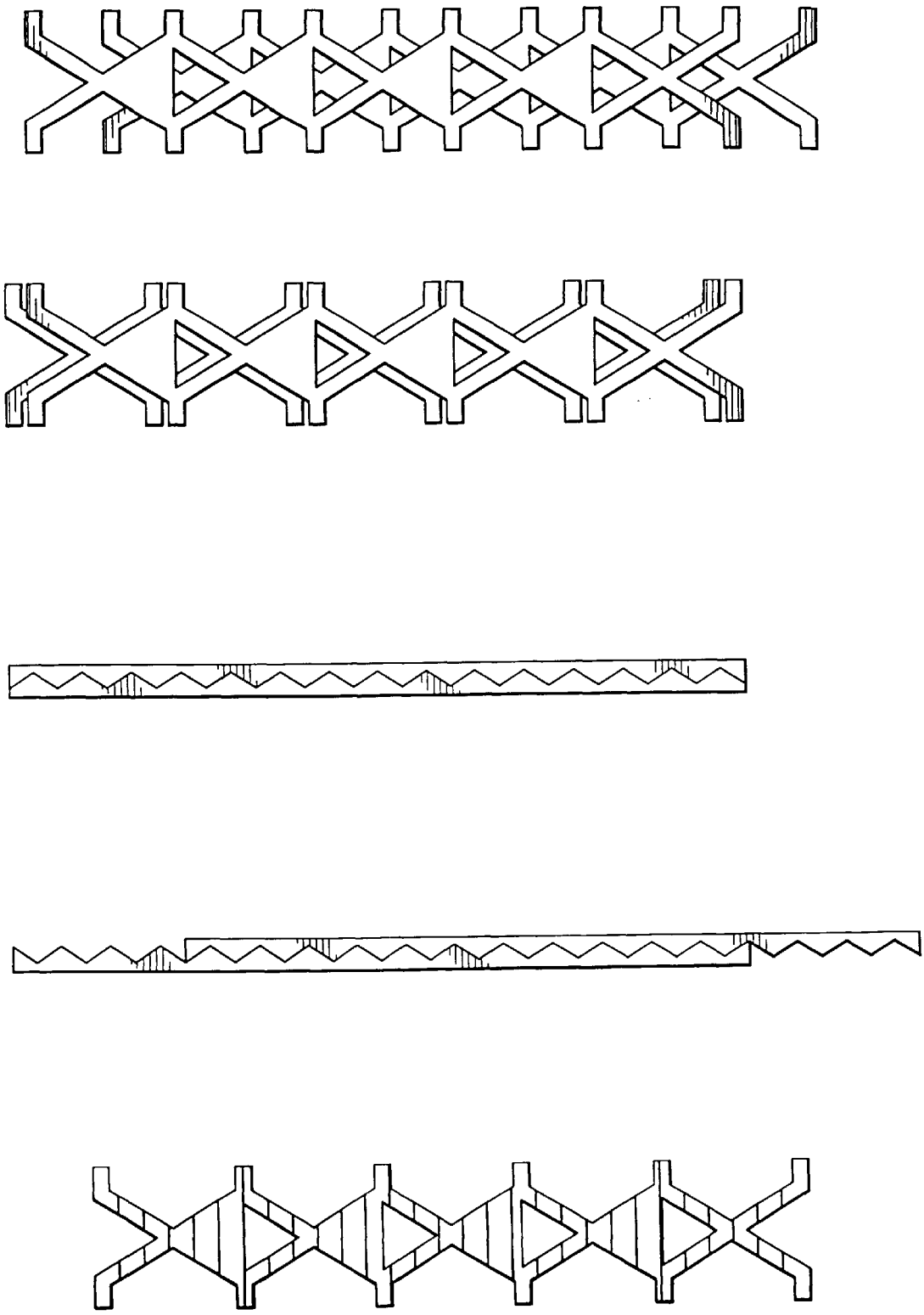
FIG. 16 is a plan view of an alternative bi-component link of the present invention.

Along with choice of material, the actual link dimensions, interconnection means, and "weave pattern" must be determined according to fabric and tooling demands. The link dimensions have been found to be most limited by practical tooling and molding considerations rather than fabric considerations. Interconnection means, such as those illustrated in FIGS. 6–16, include a pintle system, integrated pin locks, D-link and finger locks, snap supports, grip linkages, and lock-fit mechanisms. The "weave pattern" must be chosen with fabric considerations in mind, but is limited only by mold construction and paper marking considerations. It may take a variety of patterns such as the gingham-type pattern shown in FIGS. 1–4 or the alternative structures shown in FIGS. 14–16. The latter figures show a flexible matt-like structure and adjustable X-weave patterns which slide atop each other for adjusting permeability in the finished fabric.

The link 10 described below was developed for use in a corrugated paper process. In the process, the completed fabric wraps around rollers having 18 inch (45.72 cm) and 60 inch (152.4 cm) diameters. A maximum temperature of 300° F. (148.9° C.) is estimated at the fabric as it travels over steam cans having estimated temperatures up to 400° F. (204.4° C.). The temperature differential is due to a layer of pulp that separates the fabric from the steam cans. Typically, woven fabrics used in this process have a thickness of 0.140 inch (3.56 mm) and weigh approximately 5.9 oz./ft.$^2$ (1.8 kg/m$^2$). Normal running tension load on the fabric ranges from 8–15 PLI (142.9–267.9 kg/m), however, higher loads may be caused when a pulp wad passes through the rollers. Fabric thickness of the new modular fabric should approximate existing fabric thickness and, ideally, reduce weight. Since current seam strengths in woven fabrics presently range between 200–300 PLI (3572–5358 kg/m), 500 PLI (8930 kg/m) was the goal for the present example.

Figure 1:
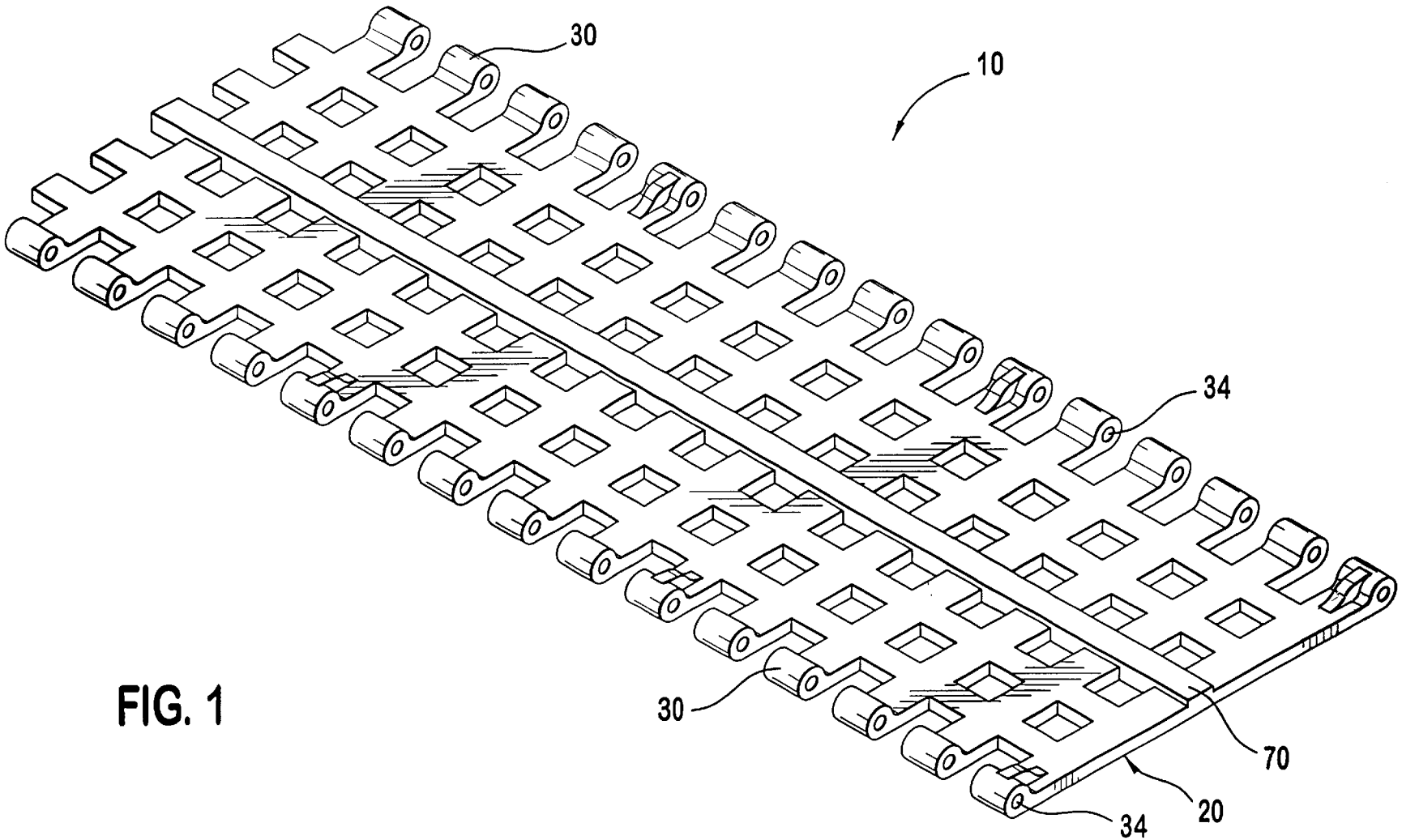
FIG. 1 is a bottom perspective view of a link of the present invention.

Keeping those requirements in mind, the link 10 was constructed generally as shown in FIGS. 1–4. As seen in FIG. 1, link 10 was molded in a generally rectangular shape having a major axis and a minor axis. The major axis relates generally to the cross-machine direction in the papermaking machine while the minor axis relates to the machine direction. A pintle system similar to that shown in FIG. 6 was chosen as the interconnection means due to its inherent strength. A plurality of individual pintle links 30 project from the two sides of the link 10 parallel to the major axis, each defining a bearing area 32 and pintle hole 34. Each pintle hole 34 is aligned with the next to form part of a pintle channel running parallel to the major axis along the length of each side. A pintle inserted through a completed pintle channel formed by interdigitating individual pintle links 30 of adjacent links 10 is used to interconnect a plurality of the links 10 to make a complete fabric. Each link 10 has an upper surface 20 which defines a planar support surface for contacting and carrying the paper web through the paper machine.

Figure 2:
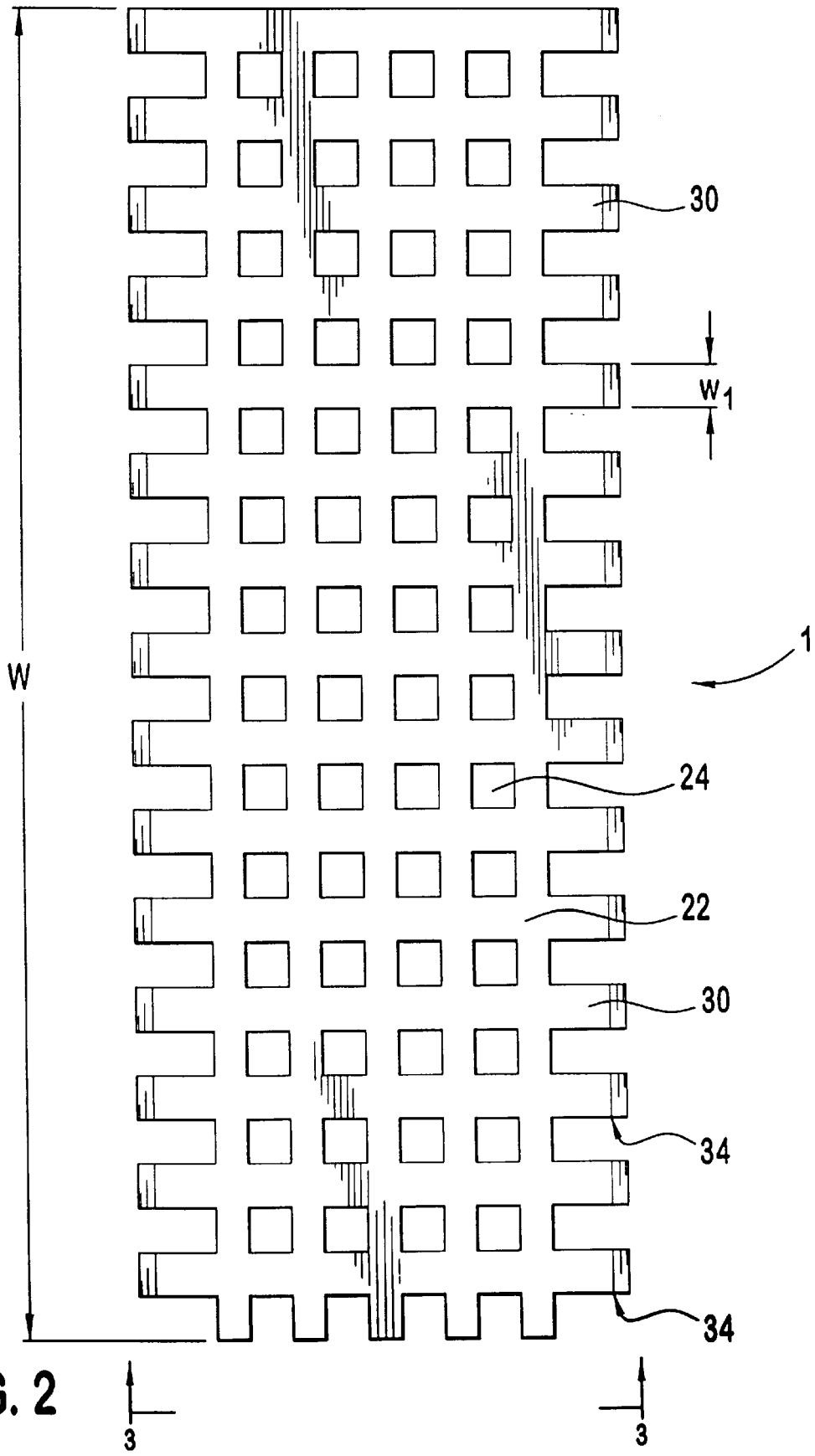
FIG. 2 is a plan view of a link of the present invention.
Figure 3:
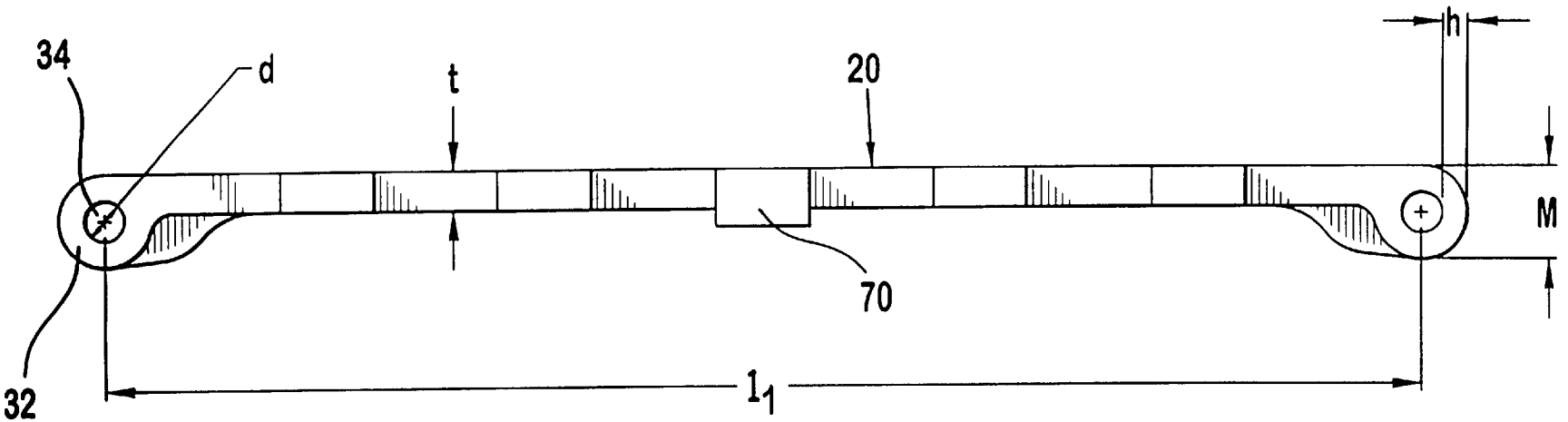
FIG. 3 is an end view of a link of the present invention as seen along line 3—3 of FIG. 2.

The link 10 was molded with a 6 inch (15.2 cm) major axis and a 2 inch (5.1 cm) minor axis. The three-to-one ratio of major axis to minor axis is believed to aid mold processability. Open area was established on the link 10 by a gingham-like pattern defining rectangular or squared openings. As shown in FIGS. 2 and 3, the link 10 thickness t was established at 0.060 in. (1.5 mm) with a 0.090 in. (2.3 mm) runner 70 centrally located parallel to the major axis, to help flow during molding. A maximum thickness M of 0.143 in. (3.6 mm) is found at each side parallel to the major axis due to the bearing thickness h, 0.040 in. (1.0 mm), surrounding the pintle hole diameter d, 0.063 in. (1.6 mm). A minimum pintle hole diameter was calculated based on an individual pintle link width w of 0.200 inch (5.1 mm). A minimum 0.044 inch (1.1 mm) diameter was calculated for a stainless steel pintle because a nylon pintle yielding the desired load capacity exceeded thickness requirements. The specific diameter, 0.063 in. (1.6 mm), was chosen for tooling reasons; it is sized to receive a 0.0625 inch (1.59 mm) diameter pintle.

The resultant weight was calculated from measured volume of the link, 0.56 in.$^3$ (9.18 cm$^3$), and known specific gravity of nylon 6/6 (1.14) to be 0.023 pounds (10.4 gm) per link. Each link has an area of 6 in. (15.2 cm)×2 in. (5.1 cm) or 12 in.$^2$ (77.5 cm$^2$) resulting in a weight per area of 0.0019 pounds per square inch (1.34 kg/m$^2$), as compared to existing fabric weight of 0.0025 pounds per square inch (5.9 oz./ft.$^2$) (1.8 kg/m$^2$). Thus, the goal of maintaining fabric thickness while reducing weight was achieved.

Figure 4:
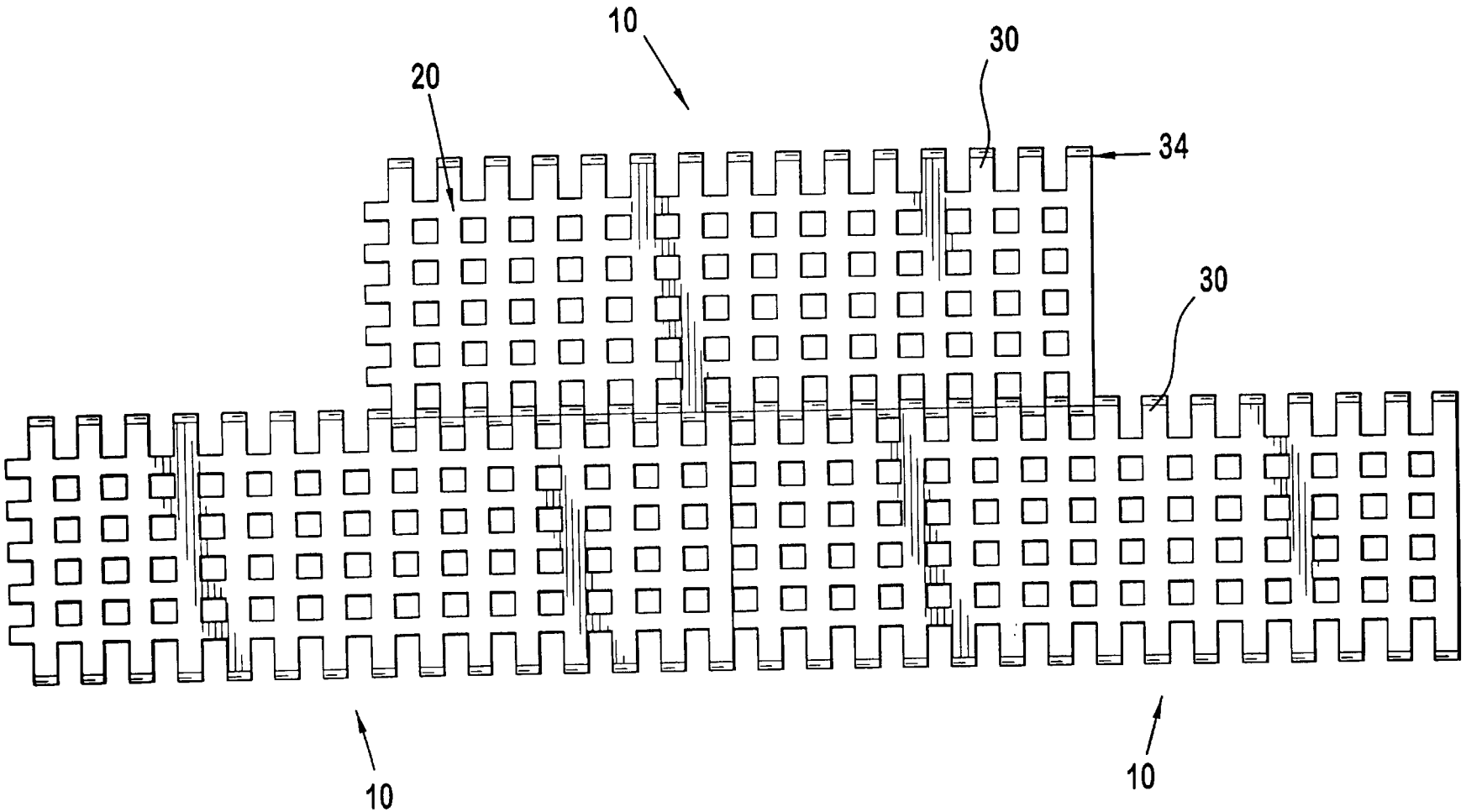
FIG. 4 is a plan view of a plurality of interconnected links of the present invention.
Figure 5:
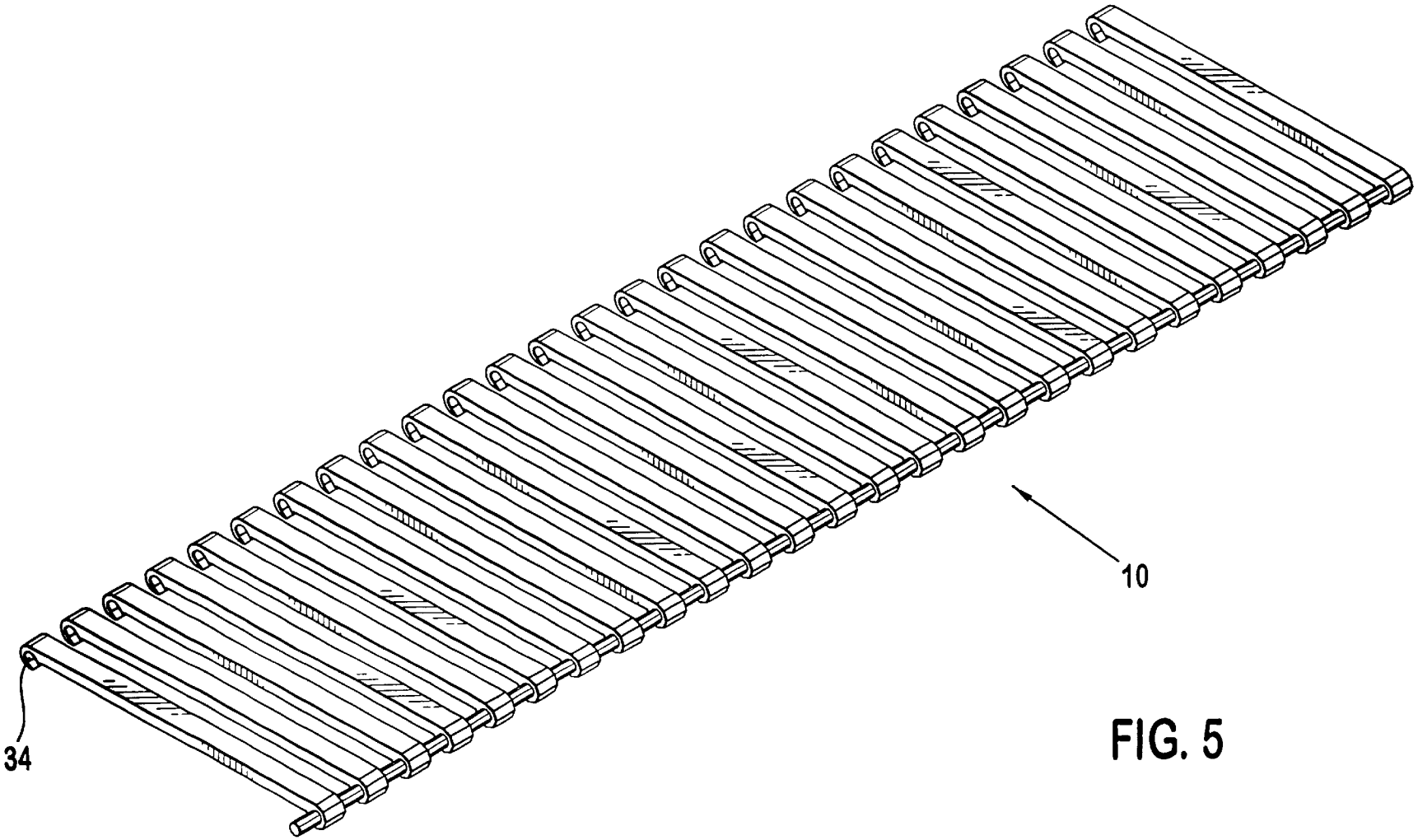
FIG. 5 is a perspective view of an alternative link of the present invention.
Figure 9:
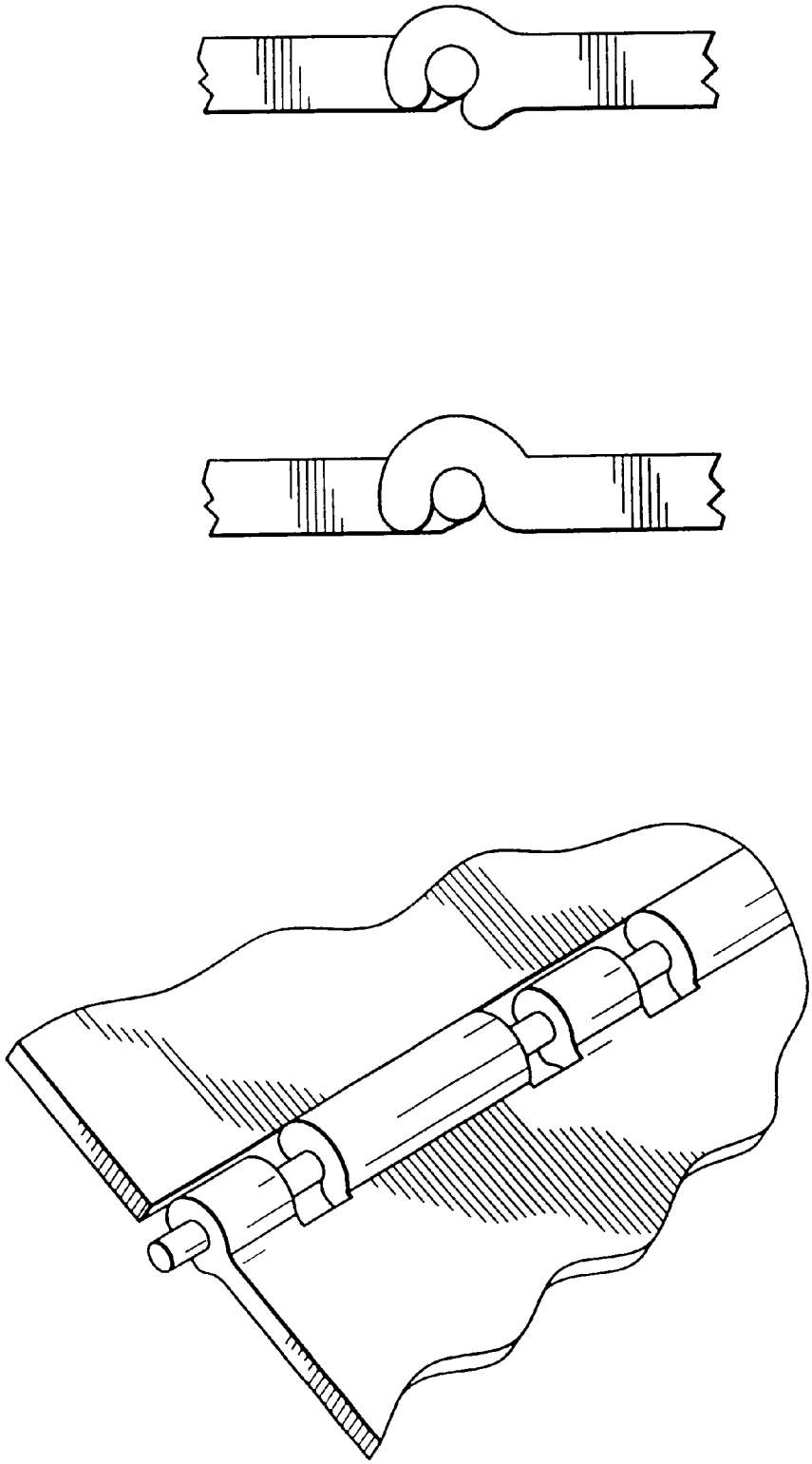
FIG. 9 is a perspective view of a snap support system for interconnecting the subassembly links of the present invention.
Figure 10:
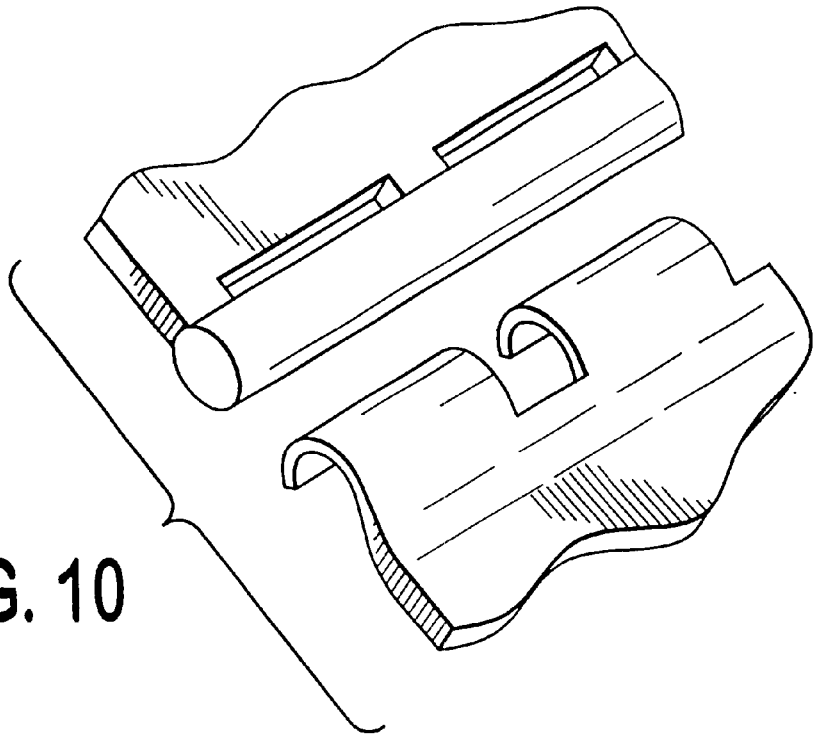
FIG. 10 is a perspective view of a finger lock system for interconnecting the subassembly links of the present invention.
Figure 11:
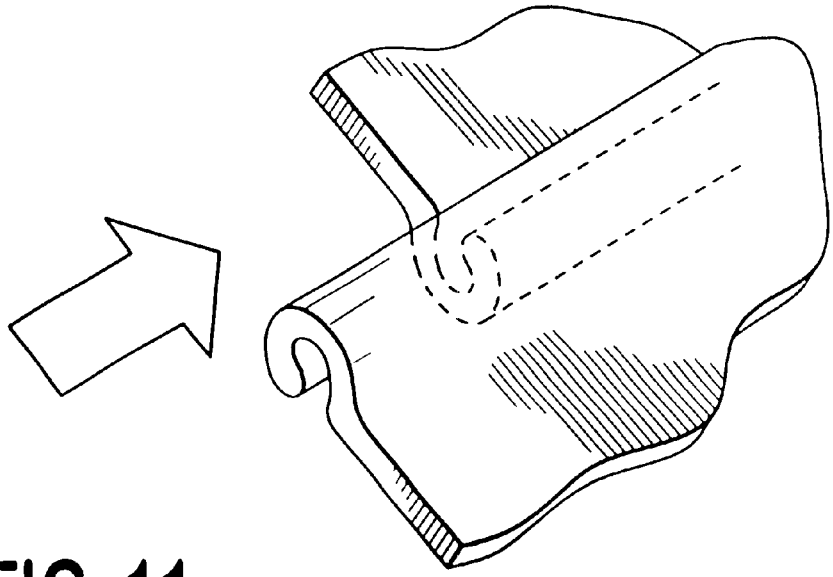
FIG. 11 is a perspective view of a grip linkage system for interconnecting the subassembly links of the present invention.
Figure 12:
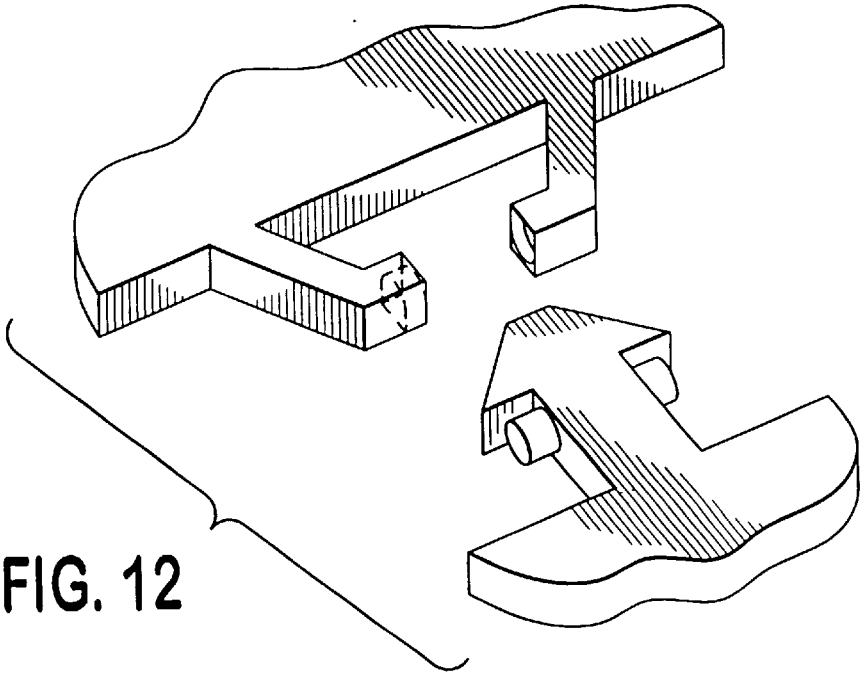
FIG. 12 is a perspective view of a lock-fit system for interconnecting the subassembly links of the present invention.
Figure 13:
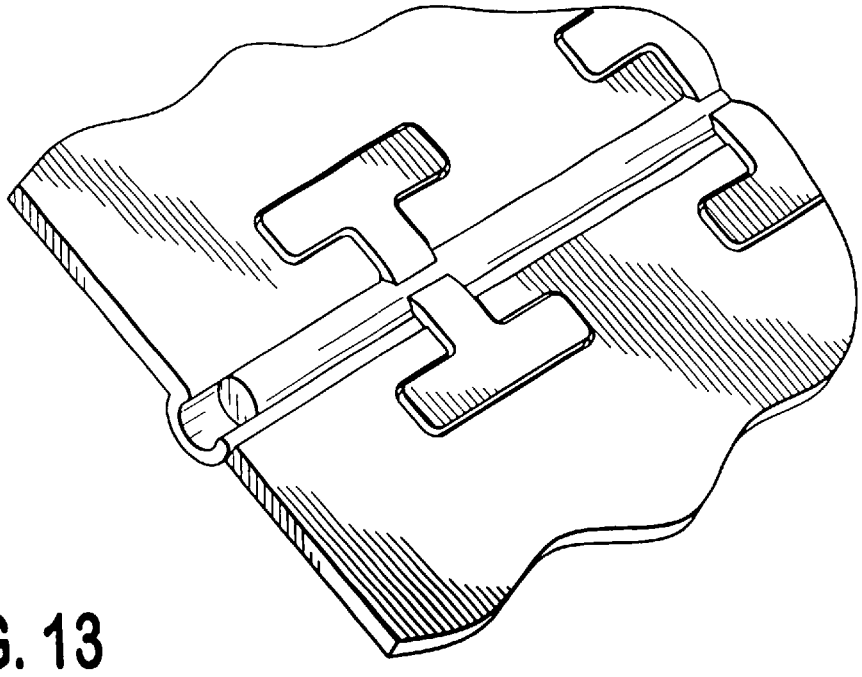
FIG. 13 is a perspective view of a I-bar lock system for interconnecting the subassembly links of the present invention.

A molded fabric establishes open area and permeability just as the weave of a traditional fabric, but without the concerns over shifting yarns and fabric stability. Although the link 10, shown in FIGS. 1–4 has a gingham-like "weave pattern" with rectangular or squared openings, circular, oval, or other shaped openings and patterns may also be employed. Because of the molded nature, even three dimensional shapes may be made in the links for desired results, such as permeability, flow control, etc. In fact, link 10 may be made using material only in the machine direction as seen in FIG. 5. Fabric stability and paper marking must be considered when designing a link and a modular papermaking fabric just as in traditional fabric design.

In making a complete fabric, a plurality of the subassembly links 10 are interconnected to form an endless belt. Fabrics constructed from the modular links are not limited in dimension by loom size as in traditional fabrics. A fabric of any size can be made by interconnecting the appropriate number of subassembly links. Preferably, a brick layered pattern as shown in FIG. 4 will be used to increase the fabric strength. In such an arrangement, each link 10 is staggered so that their individual pintle links 30 intermesh with the pintle links 30 of two other links 10. Accordingly, some sizing may be necessary at the fabric edges and final seam. This, however, can be accomplished at the edges through simple straight cuts. Alternatively, because of the modular design, special links may be molded to complete the edge without cutting. Similarly, smaller links can be molded to fill a variety of sizes that may be needed to complete the final fabric seam. Preferably, however, the overall fabric length needed will be considered when establishing link dimensions, so that special links of fractional dimensions will not be required to close the final seam.

Calendar finishing may be used on each link 10, much as in traditional fabrics. For the most uniform treatment, an assembled fabric will be subjected to the finishing treatment. For a more unique fabric, individual links can be given different surface finishes prior to assembly.

The modular design of the fabric allows for easy replacement of individual sections of the fabric. When one section of the fabric becomes damaged, worn, or dirty, it may be replaced without having to remove and replace the entire fabric. This feature alone will result in a significant cost savings over traditional papermaking fabrics. Additionally, modular papermaking fabrics are strong, stable, versatile, light-weight, easy to install, and easy to repair or replace.

What is claimed is:

1. A dryer fabric, for use in a dryer section of a papermaking machine, comprised of a plurality of molded, pliable, generally rectangular modular subassemblies (10), each of the plurality of subassemblies (10) having a generally planar upper surface (20) adapted to support a paper web, a lower surface, a major axis oriented in a cross-machine direction and a minor axis oriented in a machine direction;

the plurality of subassemblies (10) being arranged and detachably interconnected in a brick layered pattern via a plurality of pintles, each extending in the cross-machine direction, the fabric formed by the plurality of modular subassemblies (10) having a machine direction tensile strength of at least 8930 kg/m (five hundred pounds per linear inch), each of the molded pliable modular subassemblies (10) being further characterized by a major axis to minor axis size ratio of at least 3:1, a thickness of at least one point five (1.5) millimeters (mm), and a defined open area provided by at least one molded-in aperture (24) pre-formed in each of the modular subassemblies which extends from the upper surface (20) through to the lower surface to provide a desired permeability.

2. The fabric of claim 1 further characterized by each of the plurality of subassemblies (10) being molded in a generally rectilinear shape.

3. The fabric of claim 2 further characterized by each of the plurality of subassemblies (10) being secured in the fabric solely through the use of pintle connections.

4. The fabric of claim 3 further characterized by each of the plurality of subassemblies (10) being secured in the fabric by at least two pintles.

5. The fabric of claim 1 further characterized by the defined open area of each of the plurality of subassemblies (10) being provided by a plurality of apertures (24) arranged according to a gingham pattern.

6. A fabric according to claim 5 wherein the shape of the apertures (24) is selected from the group of geometric shapes including rectangular, square, circular, or oval.

7. A fabric according to claim 4 wherein the subassemblies (10) are a molded polymeric resin material and the pintles are comprised of a stainless steel.

8. A fabric according to claim 7 wherein the subassemblies (10) are comprised of nylon 6/6.

9. A fabric according to claim 1 in which the upper surface (20) of at least a portion of the subassemblies (10) are calender finished.

10. A fabric according to claim 1 in which the upper surface (20) of at least a portion of the subassemblies (10) are subjected to a surface finishing treatment.

* * * * *

UNITED STATES PATENT AND TRADEMARK OFFICE

CERTIFICATE OF CORRECTION

PATENT NO. : 6,544,389 B2
DATED : April 8, 2003
INVENTOR(S) : C. Barry Johnson

It is certified that error appears in the above-identified patent and that said Letters Patent is hereby corrected as shown below:

Column 6,
Line 61, delete “gingham”, and insert therefor -- gingham-like --.

Signed and Sealed this

Ninth Day of September, 2003

JAMES E. ROGAN
*Director of the United States Patent and Trademark Office*